US005217081A

United States Patent [19]

Waldenström et al.

[11] Patent Number: 5,217,081

[45] Date of Patent: Jun. 8, 1993

[54] TOOLS FOR CUTTING ROCK DRILLING

[75] Inventors: Mats G. Waldenström, Bromma; Udo K. R. Fischer, Vallingby; Lars H. Hillert, Saltsjö-Boo, all of Sweden; Mahlon D. Dennis, Kingwood, Tex.

[73] Assignees: Sandvik AB, Sandviken, Sweden; Diamant Boart Stratabit S.A., Brussels, Belgium

[21] Appl. No.: 715,654

[22] Filed: Jun. 14, 1991

[30] Foreign Application Priority Data

Jun. 15, 1990 [SE] Sweden ..... 9002137

[51] Int. Cl.[5] ..... E21B 10/46

[52] U.S. Cl. ..... 175/420.2; 175/433

[58] Field of Search ..... 175/329, 410, 420, 420.2, 175/433

[56] References Cited

U.S. PATENT DOCUMENTS

| | | | |
|---|---|---|---|
| 2,941,248 | 6/1960 | Hall | 18/16.5 |
| 3,141,746 | 7/1964 | De Lai | 51/307 |
| 3,757,878 | 9/1973 | Wilder et al. | 175/329 |
| 3,757,879 | 9/1973 | Wilder et al. | 175/329 |
| 4,109,737 | 8/1978 | Bovenkerk . | |
| 4,148,368 | 4/1979 | Evans . | |
| 4,274,840 | 6/1981 | Housman | 51/307 |
| 4,531,595 | 7/1985 | Housman | 175/329 |
| 4,592,433 | 6/1986 | Dennis | 175/329 |
| 4,593,776 | 6/1986 | Salesky et al. | 175/375 |
| 4,694,918 | 9/1987 | Hall . | |
| 4,707,384 | 11/1987 | Schachner et al. . | |
| 4,718,505 | 1/1988 | Fuller . | |
| 4,731,296 | 3/1988 | Kikuchi et al. . | |
| 4,743,515 | 5/1988 | Fischer et al. | 428/698 |
| 4,751,972 | 6/1988 | Jones et al. | 175/329 |
| 4,764,434 | 8/1988 | Aronsson et al. | 428/565 |
| 4,766,040 | 8/1988 | Hillert et al. | 428/552 |
| 4,784,023 | 11/1988 | Dennis | 76/108 |
| 4,811,801 | 3/1989 | Salesky et al. | 175/329 |
| 4,819,516 | 4/1989 | Dennis | 76/101 |
| 4,820,482 | 4/1989 | Fischer et al. | 419/15 |
| 4,843,039 | 6/1989 | Akesson et al. . | |
| 4,858,707 | 8/1989 | Jones et al. | 175/329 |
| 4,871,377 | 10/1989 | Frushour . | |
| 4,889,017 | 12/1989 | Fuller et al. | 175/329 |
| 4,972,637 | 11/1990 | Dyer . | |
| 5,007,207 | 4/1991 | Phaal . | |
| 5,074,623 | 12/1991 | Hedlund et al. . | |

FOREIGN PATENT DOCUMENTS

| | | |
|---|---|---|
| 272418 | 6/1988 | European Pat. Off. . |
| 2138864 | 10/1984 | United Kingdom . |

*Primary Examiner*—William P. Neuder

*Attorney, Agent, or Firm*—Burnes, Doane, Swecker & Mathis

[57] ABSTRACT

The present invention relates to a rock bit insert of cemented carbide for cutting rock drilling. The insert is provided with one or more bodies or layers of diamond or cBN produced at high pressure and high temperature in the diamond or cBN stable area.

The body of cemented carbide has a multi-structure containing eta-phase surrounded by a surface zone of cemented carbide free of eta-phase and having a low content of cobalt in the surface and a higher content of cobalt next to the eta-phase zone.

11 Claims, 5 Drawing Sheets

TOOLS FOR CUTTING ROCK DRILLING

FIELD OF THE INVENTION

The present invention concerns the field of rock bits and buttons therefor. More particularly, the invention relates to rock bit buttons for percussive and rotary crushing rock drilling. The buttons comprise cemented carbide provided with a diamond body or layer bonded by HP/HT (high pressure/high temperature) technique.

BACKGROUND OF THE INVENTION

There are three main groups of rock drilling methods: percussive, rotary crushing and cutting rock drilling. In percussive and rotary crushing rock drilling the bit buttons are working as rock crushing tools as opposed to cutting rock drilling, where the inserts work rather as cutting elements. A rock drill bit generally consists of a body of steel which is provided with a number of inserts comprising cemented carbide. Many different types of such rock bits exist having different shapes of the body of steel and of the inserts of cemented carbide as well as different numbers and grades of the inserts.

For percussive and rotary crushing rock drilling, the inserts often have a rounded shape, generally of a cylinder with a rounded top surface, generally referred to as a button.

For cutting rock drilling, the inserts often are provided with an edge acting as a cutter.

There already exists a number of different high pressure/high temperature (HP/HT) sintered cutters provided with polycrystalline diamond layers. These high wear resistant cutter tools are mainly used for oil drilling. The technique when producing such polycrystalline diamond tools using high pressure/high temperature has been described in a number of patents, e.g.:

U.S. Pat. No. 2,941,248: "High Temperature High Pressure Apparatus". U.S. Pat. No. 3,141,746: "Diamond Compact Abrasive". High pressure bonded body having more than 50% by volume diamond and a metal binder: Co, Ni, Ti, Cr, Mn, Ta, etc. These patents disclose the use of a pressure and a temperature where diamond is the stable phase.

In some later patents: e.g., U.S. Pat. Nos. 4,764,434 and 4,766,040, high pressure/high temperature sintered polycrystalline diamond tools are described. In the first patent, the diamond layer is bonded to a support body having a complex, non-plane geometry by means of a thin layer of a refractory material applied by PVD or CVD technique. In the second patent, temperature resistant abrasive polycrystalline diamond bodies are described having different additions of binder metals at different distances from the working surface.

A recent development in this field is the use of one or more continuous layers of polycrystalline diamond on the top surface of the cemented carbide button. U.S. Pat. 4,811,801 discloses rock bit buttons including such a polycrystalline diamond surface on top of the cemented carbide buttons having a Young's module of elasticity between 80 and $102\times10^6$ p.s.i., a coefficient of thermal expansion between 2.5 and $3.4\times10^{-6}$ °C$^{-1}$, a hardness between 88.1 and 91.1 HRA and a coercivity between 85 and 160 Oe. Another development is disclosed in U.S. Pat. No. 4,592,433, including a cutting blank for use on a drill bit comprising a substrate of a hard material having a cutting surface with strips of polycrystalline diamond dispersed in grooves, arranged in various patterns.

U.S. Pat. No. 4,784,023 discloses a cutting element comprising a stud and a composite bonded thereto. The composite comprises a substrate formed of cemented carbide and a diamond layer bonded to the substrate. The interface between the diamond layer and the substrate is defined by alternating ridges of diamond and cemented carbide which are mutually interlocked. The top surface of the diamond body is continuous and covering the whole insert. The sides of the diamond body are not in direct contact with any cemented carbide.

European patent application 0312281 discloses a tool insert comprising a body of cemented carbide with a layer of polycrystalline diamond and between the layer and the cemented carbide a number of recesses filled with abrasive compact material extending into the supporting body of cemented carbide.

Another development in this field is the use of cemented carbide bodies having different structures in different distances from the surface. U.S. Pat. No. 4,743,515 discloses rock bit buttons of cemented carbide containing eta-phase surrounded by a surface zone of cemented carbide free of eta-phase and having a low content of cobalt in the surface and a higher content of cobalt closer to the eta-phase zone.

U.S. Pat. No. 4,820,482 discloses rock bit buttons of cemented carbide having a content of binder phase in the surface that is lower and in the center higher than the nominal content. In the center there is a zone having a uniform content of binder phase. The tungsten carbide grain size is uniform throughout the body.

OBJECTS OF THE INVENTION

An object of the invention is to provide a drill bit cutter of cemented carbide with one or more embedded bodies and/or layers of diamond and/or cBN with high and uniform compression of the diamond or cBN by sintering at high pressure and high temperature in the diamond or cBN stable area.

It is a further object of the invention to make it possible to maximize the effect of diamond of cBN on the resistance to cracking, chipping and wear.

SUMMARY OF THE INVENTION

According to the present invention there is provided a rock cutter insert for cutting rock drilling comprising a body of cemented carbide according to U.S. Pat. No. 4,743,515 (the disclosure of which is hereby incorporated by reference) containing diamond and/or cBN bonded at high pressure and high temperature, said insert having a multi-phase structure with a core containing eta-phase surrounded by a surface zone free of eta-phase. The diamond and/or cBN may be in the form of a body embedded within the cemented carbide body and/or as a layer atop that body.

The cutter above can be adapted to different types of rock by changing the material properties and geometries of the cemented carbide and/or the diamond or cBN, especially hardness, elasticity and thermal expansion, giving different wear resistance and impact strength of the bits. Hammer impact tests of inserts of the type described in U.S. Pat. No. 4,784,023, with a substrate of cemented carbide and a diamond layer bonded to the substrate (FIG. 1) revealed a tendency of chipping off part of the diamond layer after a number of blows.

When using a cemented carbide body having a multi-structure according to U.S. Pat. No. 4,743,515, with a diamond layer (FIG. 2), it was surprisingly found that the chipping off tendency of the diamond layer considerably decreased compared to the corresponding geometry and composition without the multi-structure carbide (FIG. 1).

A similar improvement was achieved for inserts having a layer of cBN and comparing cemented carbide bodies with and without a multi-structure according to U.S. Pat. No. 4,743,515. The explanation of this effect is that the increase of the resistance against chipping might give a favorable stress pattern caused by the difference between the thermal expansion of the diamond layer and the cemented carbide body giving the layer a high and uniform compressive prestress.

BRIEF DESCRIPTION OF THE DRAWINGS

1=cemented carbide insert
2=steel body
3=diamond of cBN body
4=cemented carbide: Co-poor zone
5=cemented carbide: Co-rich zone
6=cemented carbide: eta-phase containing zone

DETAILED DESCRIPTION OF THE PREFERRED EMBODIMENTS OF THE INVENTION

Figure 1A:
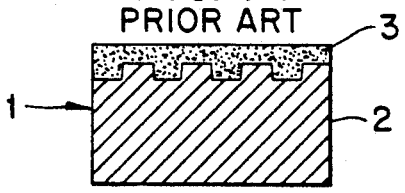
FIG. 1A PRIOR ART
FIGS. 1*a–b* show cross sectional and top views, respectively, of a prior art cemented carbide insert having a layer of polycrystalline diamond.

The rock cutter according to the present invention is provided with one or more embedded bodies and/or a coating of one or more layers of diamond and/or cBN. The coating can have different shapes such as a completely covering layer on top of the insert of cemented carbide or strips of different shapes and patterns on top of the cemented carbide insert. Each strip includes a working face exposed at the surface of the cemented carbide insert. The strips may extend toward a peripheral edge of the insert and may terminate short of such edge or extend all the way thereto.

The strips may be non-intersecting or could be interconnected such as at their ends to form an undulating pattern, or chevrons for example. An outer curvilinear strip may interconnect outer ends of other strips to form an extended cutting edge for use in softer formations. The strips may comprise two sets of strips, with each set extending toward a different section of the peripheral edge: the strips of one set may be spaced from the strips of the other set by a central region of the cutting surface.

The bodies of diamond and/or cBN may be placed regularly or irregularly on the top of the insert. Different sizes and shapes of the bodies may be mixed. Other modifications, too, are obvious to those skilled in the art.

The diamond or cBN may be thermally stable or thermally unstable.

The diamond and/or cBN can be sintered in place in grooves, for example.

The grooves may have a depth in the range from 0.2–3.5 mm (micrometer) and a width in the range of from 0.2–4.0 mm. The grooves may include undercut portions to promote stability of the diamond or cBN strips. The cutting insert is preferably brazed to a holder, such as a cemented carbide stud, and the stud is preferably press-fit into a drill-bit. However, brazing is often sufficient.

The diamond or cBN bodies or layers shall be adapted to the type of rock and drilling method by varying the grain size of the diamond or cBN feed stock and the amount of catalyst metal.

The grain size of the diamond or cBN shall be 3–500 mm, preferably 10–150 mm. The diamond or cBN may be of only one nominal grain size or consist of a mixture of sizes, such as 80 w/o of 40 mm and 20 w/o 10 mm. Different types of catalyst metals can be used such as Co, Ni, Mo, Ti, Zr, W, Si, Ta, Fe, Cr, Al, Mg, Cu, etc., or alloys between them. See U.S. Pat. No. 4,766,040, the disclosure of which is herein incorporated by reference. The amount of catalyst metal shall be 1–40% by volume, preferably 3–20% by volume.

In addition, other hard materials, preferably less than 50% by volume can be added, such as: diamond, cBN, $B_4C$, $TiB_2$, SiC, ZrC, WC, TiN, ZrB, ZrN, TiC, (Ta,Nb)C, Cr-carbides, AlN, $Si_3N_4$, $AlB_2$, etc., as well as whiskers of BC, SiC, TiN, $Si_3N_4$, etc. (See U.S. Pat. No. 4,766,040).

The bodies of diamond or cBN may have different levels of catalyst metal at different distances from the working surface according to U.S. Pat. No. 4,766,040.

The cemented carbide grade shall be chosen with respect to type of rock and drilling methods. It is important to choose a grade which has a suitable wear resistance compared to that of the diamond or cBN body or coating. The binder phase content shall be 3–35% by weight, preferably 5–25% by weight for cutting rock drilling cutters and the grain size of the cemented carbide at least 1 mm, preferably 2–6 mm.

The cemented carbide insert shall have a core containing eta-phase. The size of this core shall be 10–95%, preferably 30–65% of the total amount of cemented carbide in the insert.

The core should contain at least 2% by volume, preferably at least 10% by volume of eta-phase but at most 60% by volume, preferably at the most 35% by volume.

In the zone free of eta-phase, the content of binder phase (i.e., in general the content of cobalt), shall in the surface be 0.1–0.9, preferably 0.2–0.7 the nominal content of the binder phase and the binder phase content shall increase in the direction towards the core up to a maximum of at least 1.2, preferably 1.4–2.5, of the nominal content of the binder phase. The width of the zone poor in binder phase shall be 0.2–0.8, preferably 0.3–0.07, of the width of the zone free of eta-phase, but at least 0.4 mm and preferably at least 0.8 mm in width.

The bodies of polycrystalline diamond may extend a shorter or longer distance into the cemented carbide body and the diamond or cBN body can be in contact with all three described zones, preferably in contact only with the cobalt poor zone.

In one embodiment, the diamond or cBN bodies consist of prefabricated and sintered bodies in which the catalyst metal has been extracted by acids.

The bodies or layers are attached by the HP/HT technique. The HP/HT technique gives a favorable stress distribution and a better thermal stability because of the absence of catalyst metal in the diamond or cBN.

The cemented carbide inserts are manufactured by powder metallurgical methods according to U.S. Pat. No. 4,743,515. The holes for the diamond or cBN bodies are preferably made before sintering either in a separate operation or by compacting in a specially designed tool.

After sintering of the cemented carbide, the mixture of diamond or cBN powder, catalyst metal and other ingredients are put in the holes or on the surface of the cemented carbide body, enclosed in thin foils and sintered at high pressure, more than 3.5 GPa, preferably at 6–7 GPa and at a temperature of more than 1100° C., preferably 1700° C. for 1–30 minutes, preferably about 3 minutes.

The content of catalyst metal in the diamond or cBN body or layer may be controlled either by previously coating the insert with a thin layer of, e.g., TiN by CVD- or PVD-methods or by using thin foils such as Mo as disclosed in U.S. Pat. No. 4,764,434.

After high-pressure sintering, the insert is blasted and ground to final shape and dimension.

The invention is additionally illustrated in connection with the following Examples which are to be considered as illustrative of the present invention. It should be understood, however, that the invention is not limited to the specific details of the Examples.

EXAMPLE 1

Diamond

Figure 2A:
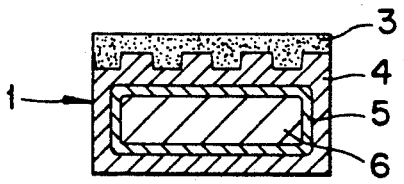
FIGS. 2*a–b* show cross sectional and top view, respectively, of a cemented carbide insert according to the invention having the same type of layer of diamond as in FIG. 1, but with the cemented carbide containing eta-phase surrounded by a surface zone of cemented carbide free of eta-phase.
Figure 1B:
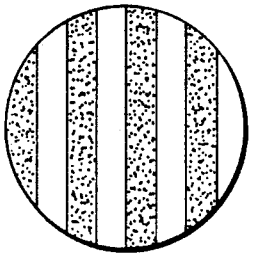
FIG. 1B PRIOR ART
Figure 2B:
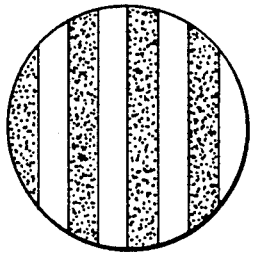
Figure 3A:
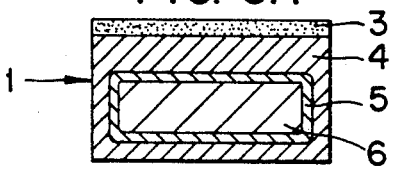
FIGS. 3*a*–30*b* show cross sectional and top views of various embodiments of cemented carbide rock cutter inserts according to the invention, i.e., provided with different bodies or layers of diamond or cBN in or on the surface. The inserts according to FIGS. 5*a*–30*b* can also be provided with at least one layer of diamond and/or cBN partly or completely covering the insert. The core of the cemented carbide insert in all cases contains eta-phase surrounded by a surface zone of cemented carbide free of eta-phase.
Figure 4A:
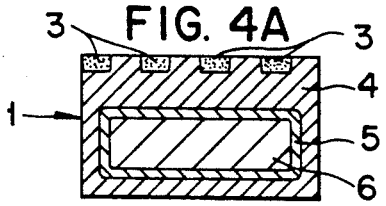
Figure 3B:
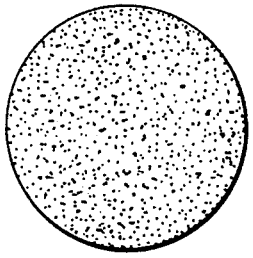
Figure 4B:
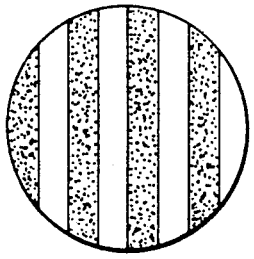
Figure 5A:
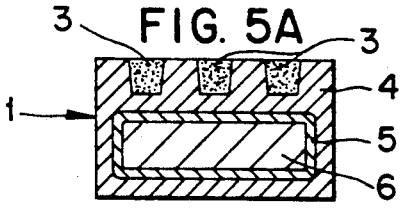
Figure 6A:
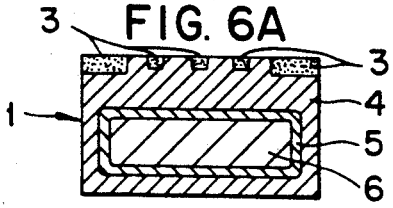
Figure 5B:
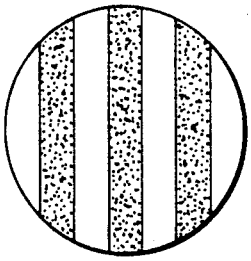
Figure 6B:
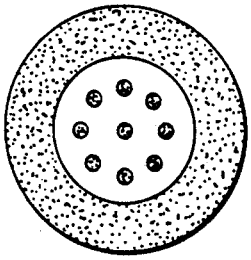
Figure 7A:
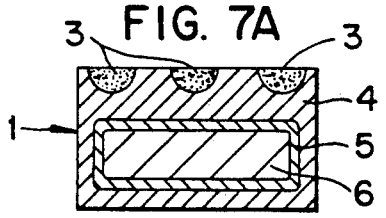
Figure 8A:
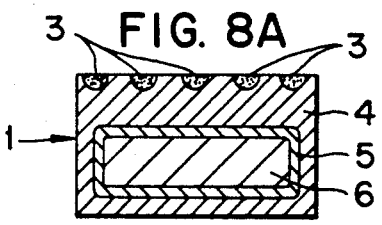
Figure 7B:
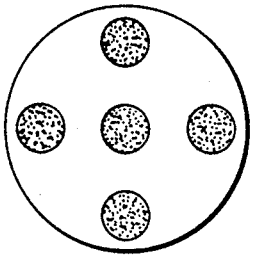
Figure 8B:
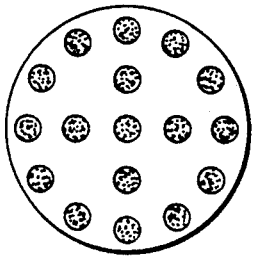
Figure 9A:
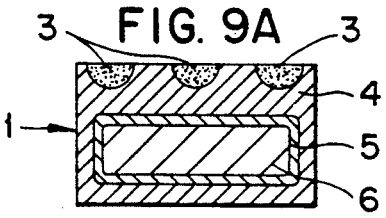
Figure 10A:
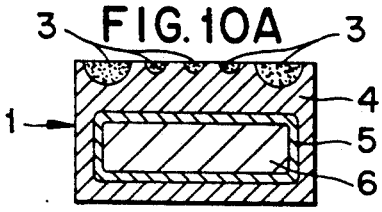
Figure 9B:
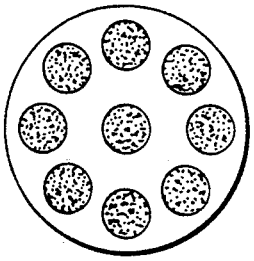
Figure 10B:
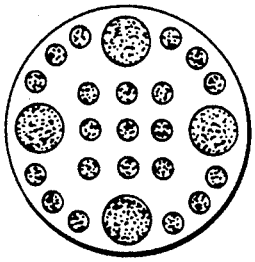
Figure 11A:
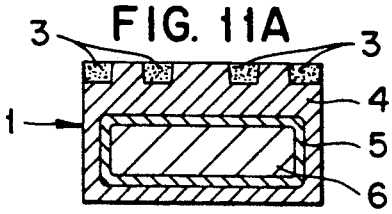
Figure 12A:
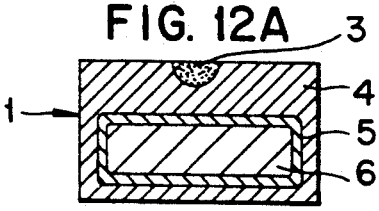
Figure 11B:
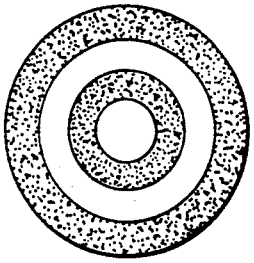
Figure 12B:
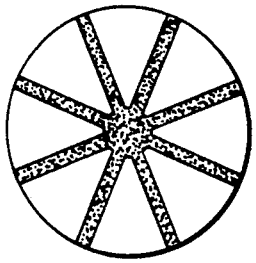
Figure 13A:
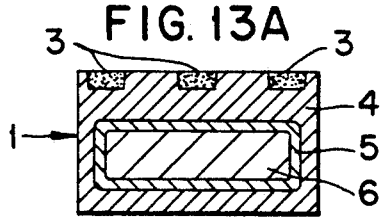
Figure 14A:
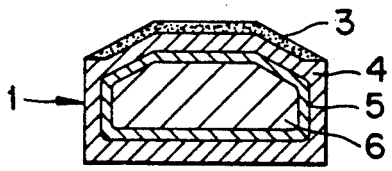
Figure 13B:
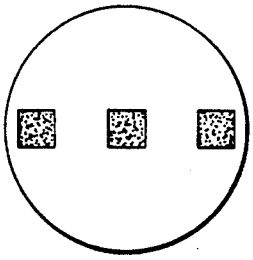
Figure 14B:
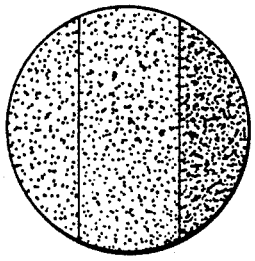
Figure 15A:
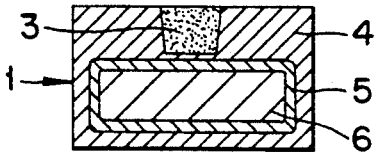
Figure 16A:
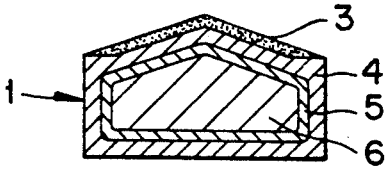
Figure 15B:
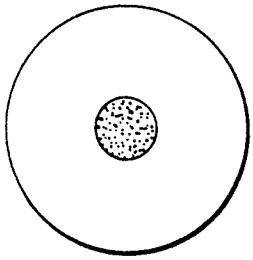
Figure 16B:
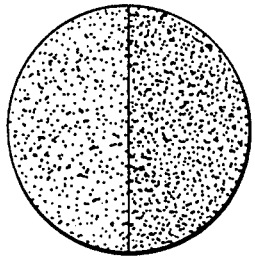
Figure 17A:
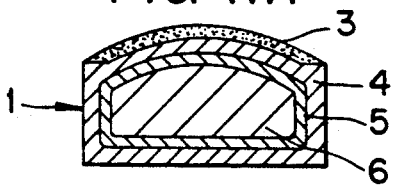
Figure 18A:
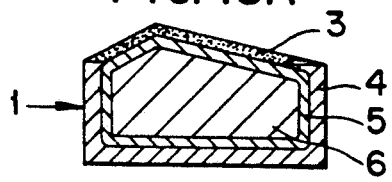
Figure 17B:
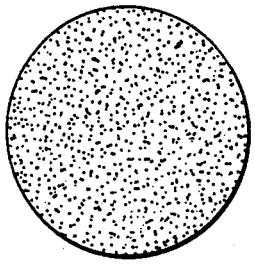
Figure 18B:
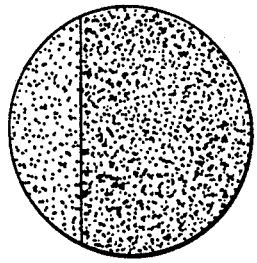
Figure 19A:
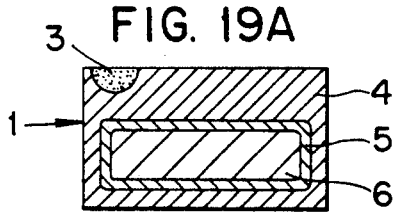
Figure 20A:
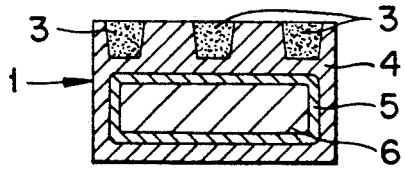
Figure 19B:
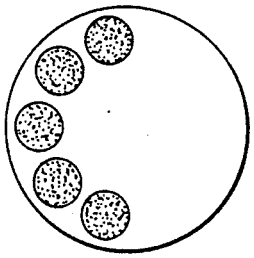
Figure 20B:
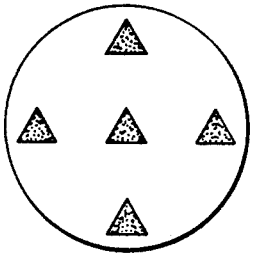
Figure 21A:
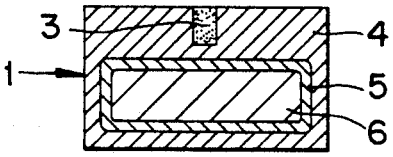
Figure 22A:
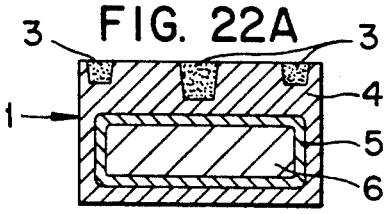
Figure 21B:
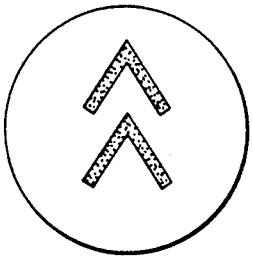
Figure 22B:
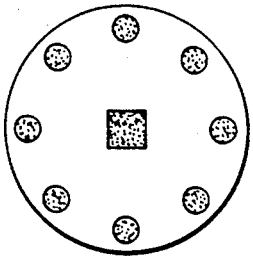
Figure 23A:
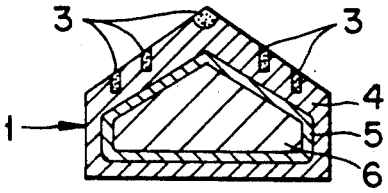
Figure 24A:
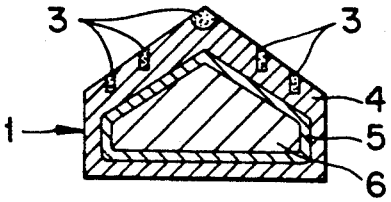
Figure 23B:
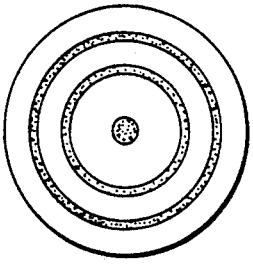
Figure 24B:
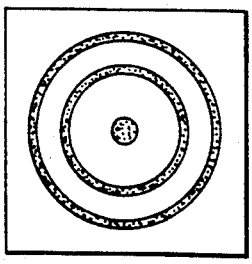
Figure 25A:
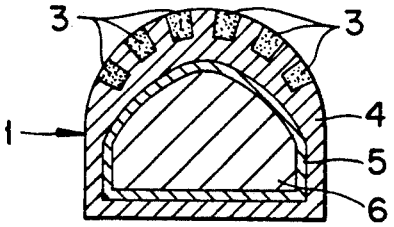
Figure 26A:
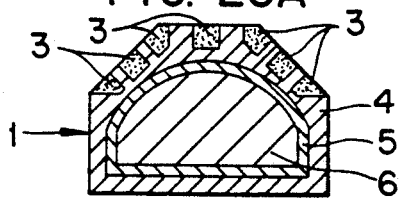
Figure 25B:
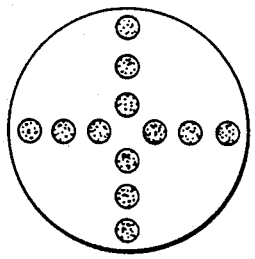
Figure 26B:
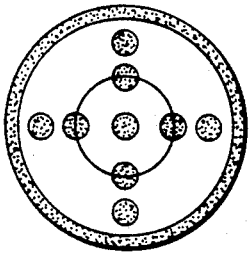
Figure 27A:
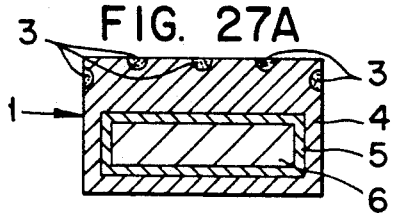
Figure 28A:
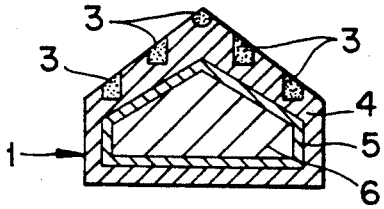
Figure 27B:
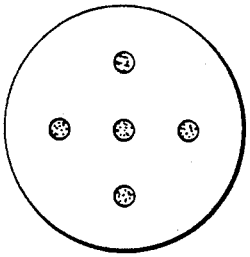
Figure 28B:
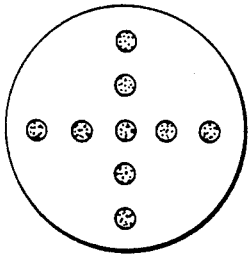
Figure 29A:
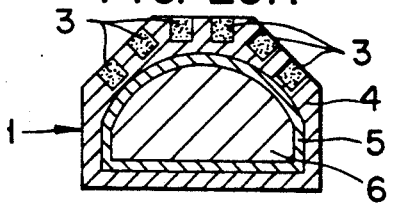
Figure 30A:
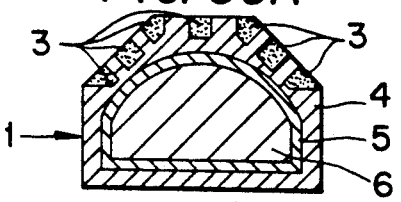
Figure 29B:
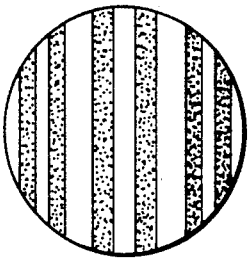
Figure 30B:
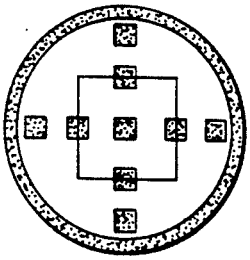

A hammer impact test was made using a modified Charpy pendulum of diamond inserts according to FIG. 2 with and FIG. 1 without eta-phase core. The diamond layer had a thickness of 0.7 mm. The total height of the inserts was 3.5 mm and the diameter 13.3 mm.

The hammer was released from a certain height and the chipping was observed after each blow. The number of blows before chipping was taken as the measure of the shock resistance.

| RESULTS | Number of blows before chipping |
|---|---|
| Insert without eta-phase core (FIG. 1) | 5 |
| Insert according to the invention (FIG. 2) | 8 |

EXAMPLE 2 cBN

Example 1 was repeated but with a cBN instead of a diamond coating with the difference that the hammer was released from another height.

| RESULTS | Number of blows before chipping |
|---|---|
| Insert without eta-phase core (FIG. 1) | 7 |
| Insert according to the invention (FIG. 2) | 9 |

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A rock cutter insert for cutting rock drilling comprising a body of cemented carbide containing diamond and/or cBN bonded at high pressure and high temperature, said insert having a multi-phase structure with a core containing eta-phase surrounded by a surface zone free of eta-phase.

2. The rock cutter insert of claim 1, wherein the binder phase content of the cemented carbide in a zone close to the eta-phase containing core is higher than the nominal binder phase content.

3. The rock cutter insert of claim 2, wherein the binder phase content in the surface of said insert is 0.1–0.9 the nominal binder phase content.

4. The rock cutter insert of to claim 1, wherein the grain size of the hard phase is preferably 80% by volume of 40 mm and 20% by volume 10 mm material.

5. The rock cutter insert of claim 1, wherein said insert is a disc-shaped cutter insert.

6. The rock cutter insert of claim 5, wherein at least a portion of the said diamond and/or cBN is in the form of a body embedded in the said body of cemented carbide.

7. The rock cutter insert of claim 6, wherein said portion is embedded in one or more stripes across the surface of said body.

8. The rock cutter insert of claim 6, wherein said portion is embedded in one or more circular portions.

9. The rock cutter insert of claim 1, wherein said diamond and/or cBN is in the form of a layer at least partly covering the top surface of said insert.

10. The rock cutter insert of claim 6, wherein at least another portion of said diamond and/or cBN is in the form of a layer at least partly covering the top surface of said insert.

11. The rock cutter insert of claim 10, wherein at least a portion of said layer covers at least a portion of said body.

* * * * *